US005799647A

United States Patent [19]

Mills

[11] Patent Number: 5,799,647

[45] Date of Patent: Sep. 1, 1998

[54] OVEN DOOR WINDOW UNIT

[75] Inventor: Bob D. Mills, Brentwood, Tenn.

[73] Assignee: Mills Products, Inc., Brentwood, Tenn.

[21] Appl. No.: 928,230

[22] Filed: Sep. 12, 1997

[51] Int. Cl.[6] ..... F23M 7/00

[52] U.S. Cl. ..... 126/200

[58] Field of Search ..... 126/190, 200

[56] References Cited

U.S. PATENT DOCUMENTS

| | | | |
|---|---|---|---|
| 4,041,930 | 8/1977 | Katona | 126/200 |
| 4,048,978 | 9/1977 | Plumat et al. | 126/200 |
| 4,253,286 | 3/1981 | Katona | 126/200 |
| 5,029,571 | 7/1991 | Trosin | 126/200 |

*Primary Examiner*—Carroll B. Dority
*Attorney, Agent, or Firm*—Barnes, Kisselle, Raisch, Choate, Whittemore & Hulbert, P.C.

[57] ABSTRACT

A window unit for an oven door having a pair of rectangular window panels held in spaced parallel relation by a frame. The frame is an endless rectangular member. The sides and ends of the frame are generally U-shaped in cross-section having spacer flanges engaging the inner faces of the panels to hold the panels spaced apart. Retainer flanges extend laterally outwardly from the spacer flanges over the edges of the panels. Clips are provided to clamp the panels to the frame.

10 Claims, 2 Drawing Sheets

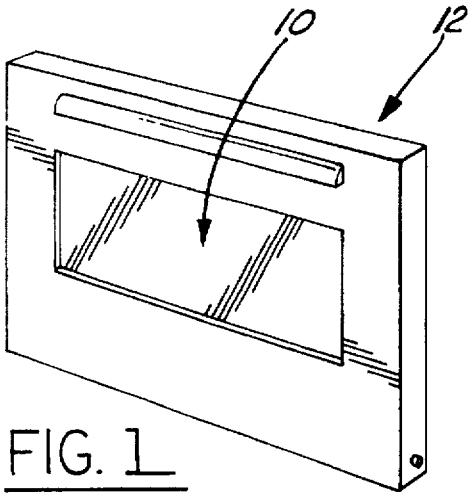
FIG. 1
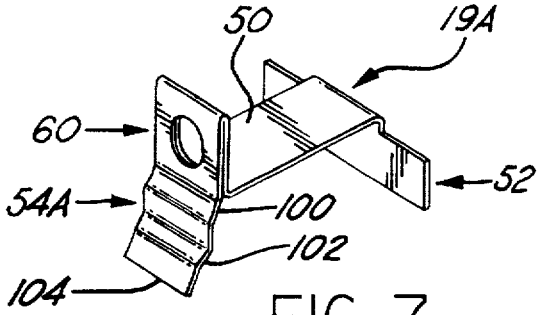
FIG. 7
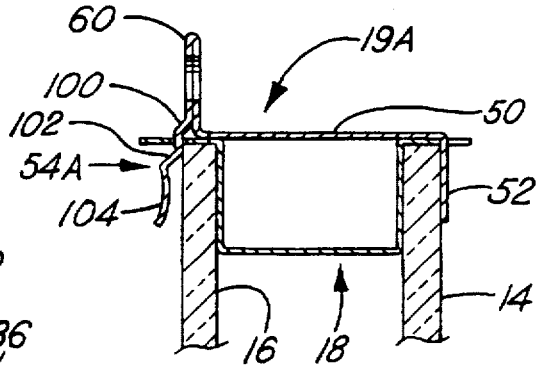
FIG. 8
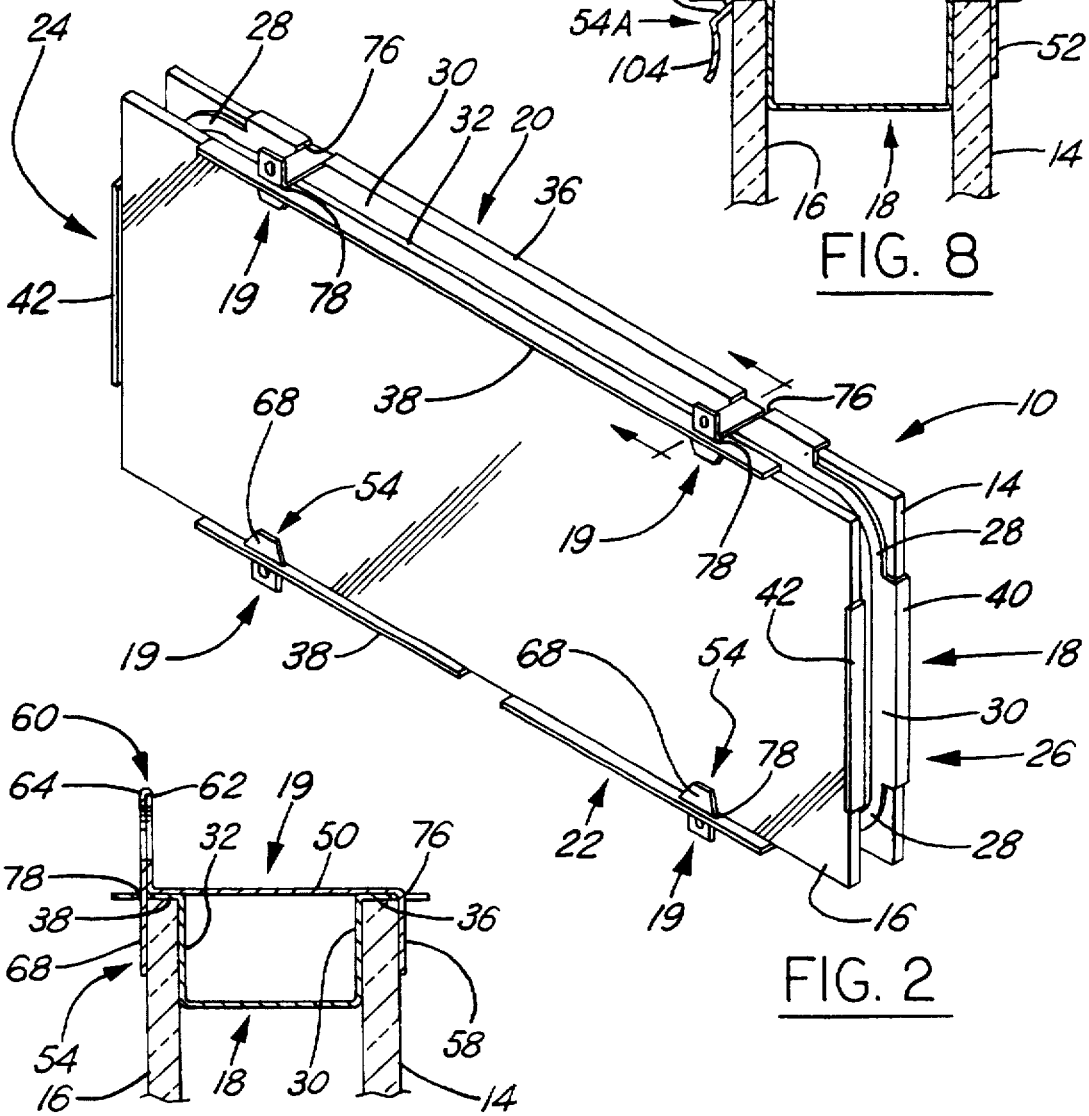
FIG. 2
FIG. 3

OVEN DOOR WINDOW UNIT

FIELD OF THE INVENTION

This invention relates generally to window units and refers more particularly to a window unit for an oven door.

BACKGROUND AND SUMMARY OF THE INVENTION

Typically the window unit of an oven door comprises two window panels held in laterally spaced-apart, parallel relation by a clamping frame and a spacer. The clamping frame extends around the entire periphery of the window panels, and the spacer fits between the panels.

In the window unit of U.S. Pat. No. 5,029,571, the frame has clamping sections along the edges of the window panels. At the corners of the panels, the frame has spacers extending between the ends of the clamping sections to hold the panels apart. The frame is in the form of a one-piece strip of flexible, bendable material extending around the periphery of the panels with the ends secured together by a flexible tab.

In accordance with the present invention, the frame is an endless, generally rectangular member. The frame is U-shaped in cross-section and has radially outwardly extending spacer flanges engaging the inner faces of the panels to hold the panels spaced apart. At their outer edges, the spacer flanges have retainer flanges which extend over the edges of the panels. Clips are provided to clamp the panels to the frame. Preferably, the frame is made of metal or other flexible, bendable material.

One object of this invention is to provide a window unit having the foregoing features and capabilities.

Another object is to provide a window unit which is composed of a relatively few simple parts, is rugged and durable in use, and is relatively inexpensive and easy to manufacture.

Other objects, features and advantages of the invention will become more apparent as the following description proceeds, especially when considered with the accompanying drawings.

BRIEF DESCRIPTION OF THE DRAWINGS

FIG. 1 is a perspective view of an oven door having a window unit constructed in accordance with this invention.

FIG. 2 is a perspective view of the window unit.

FIG. 3 is a sectional view taken on the line 3—3 in FIG. 2.

FIG. 7 is a perspective view of a clip having a modified construction.

FIG. 8 is a sectional view similar to FIG. 3 showing the modified clip in place in the window unit.

DETAILED DESCRIPTION OF THE PREFERRED EMBODIMENT

Figure 4:
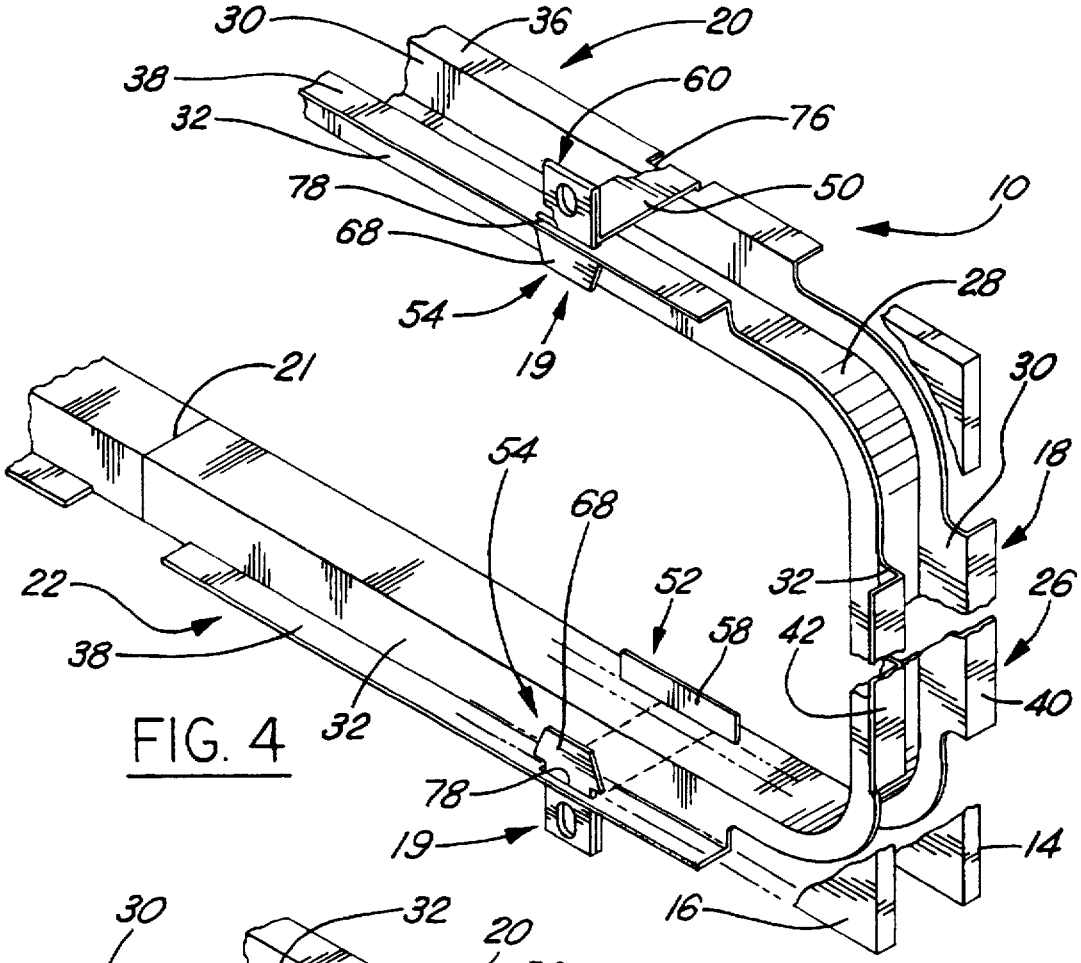
FIG. 4 is an enlarged perspective view of a portion of the window unit as seen from the front, with parts broken away.

Referring now more particularly to the drawings, and especially to FIGS. 1–6, there is shown a multi-pane window unit 10 mounted by any suitable means in the window opening of an oven door 12. The window unit 10 comprises a pair of rectangular window panels or panes 14 and 16 of glass or the like transparent or translucent material, a frame 18, and clips 19.

The panels 14 and 16 are of identical rectangular size and shape and are in spaced parallel planes, one behind the other. The top and bottom side edges of the two panels are respectively in opposed parallel relation to one another, as are the right and left end edges thereof.

The frame 18 is preferably made of a one-piece strip of metal or other flexible, bendable material which is bent into the rectangular form shown, with the opposite ends welded or otherwise permanently secured together at 21.

The frame 18 has the vertically spaced, parallel, horizontal sides 20 and 22 and laterally spaced, parallel, vertical ends 24 and 26, with curved comer portions 28 connecting the sides and ends. The frame sides 20 and 22 extend along the top and bottom side edges of the two panels, and the frame ends 24 and 26 extend along the end edges of the panels.

Figure 5:
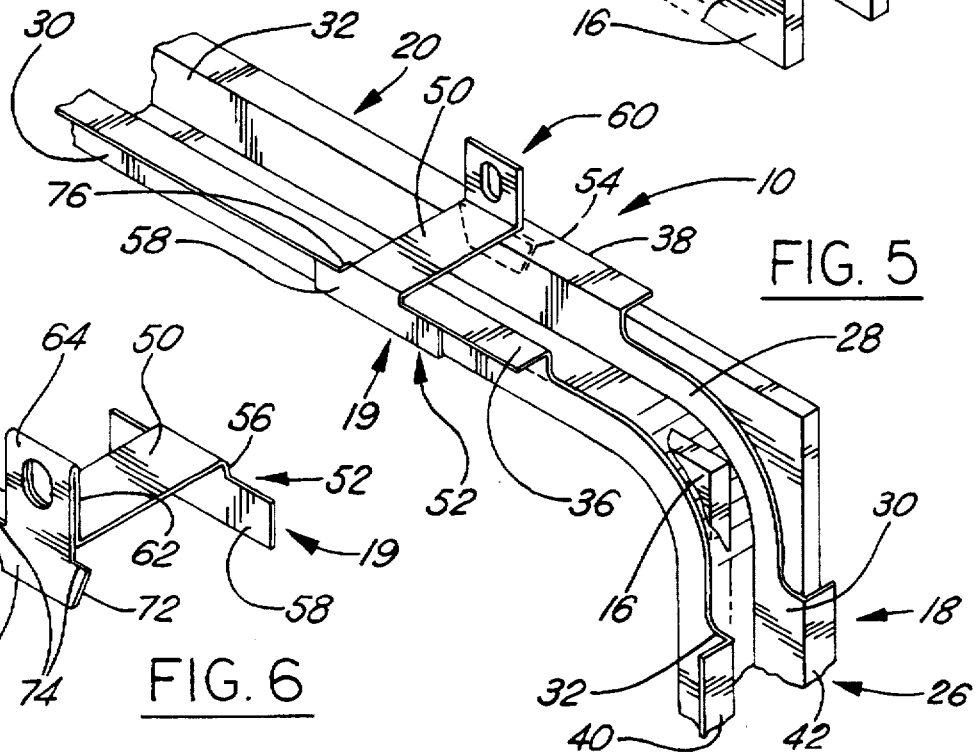
FIG. 5 is a perspective view of a portion of the window unit, but as seen from the rear.

Each of the sides and ends of the frame is generally U-shaped in cross-section having laterally spaced, radially outwardly extending, parallel spacer flanges 30 and 32 engaging the inner faces of the panels to hold the panels spaced apart. The comer portions 28 of the frame are also generally U-shaped although the flange portions 34 thereof are cut back somewhat as shown in FIGS. 2, 4 and 5.

Each of the side spacer flanges 30,32 of the sides 20 and 22 of the frame have side retainer flanges 36 and 38 which extend laterally outwardly from the outer extremities of the side spacer flanges 30,32 over the side edges of the panels. Each of the end spacer flanges 30 and 32 of the ends 24 and 26 of the frame have end retainer flanges 40 and 42 which extend laterally outwardly from the outer extremities of the end spacer flanges 30,32 over the end edges of the panels.

Figure 6:
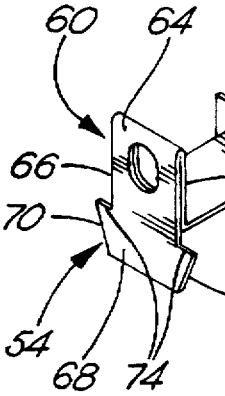
FIG. 6 is a perspective view of one of the clips for clamping the window panels to the frame.

The clips 19 are identical and one such clip is shown in FIG. 6. Each clip 19 is of integral, one-piece construction, and has a central, flat, elongated, rectangular strip 50 and abutments 52 and 54 at the ends. The abutments 52 and 54 are laterally spaced apart and parallel, extending in the same direction from the strip 50 and perpendicular to the strip.

The abutment 52 is generally T-shaped and extends inwardly from the strip 50, having a narrow portion 56 of the same width as the strip 50, and a wide rectangular portion 58. The narrow portion 56 is integrally connected to the strip 50.

The abutment 54 is in the form of a tab on a terminal part of the clip designated 60. The part 60 has an outwardly extending portion 62 which is integrally connected to the strip 50. The outer extremity of the portion 62 is integrally connected to a portion 64 which is bent or folded back upon the portion 62. The portion 64 extends inwardly past the plane of the strip 50 to provide the abutment 54. The entire terminal part 60 is perpendicular to the strip The abutment 54 has a narrow portion 66 and a wider portion 68 which is a locking formation shaped similarly to an arrow head. The narrow portion 66 is the same width as the strip 50. The locking formation 68 has outwardly tapering sides 70 and 72 which converge outwardly at the same angle, with a shoulder 74 at each side of the locking formation that connects into the narrow portion 66.

The clips 19 may be made from an initially flat length of metal or other flexible, bendable material.

There are preferably four clips 19, two at the top and two at the bottom of the frame 18. The retainer flange 36 at the top of the frame and the retainer flange 36 at the bottom of the frame each have laterally spaced notches 76. The width of the notches is equal to or slightly greater than the width of the narrow portion 56 of the abutment 52.

The retainer flange 38 at the top of the frame and the retainer flange 38 at the bottom of the frame each have laterally spaced slots 78 which are elongated lengthwise of the flange. The length of the slots 78 is slightly greater than the width of the narrow portion 66 of abutment 54, and slightly less than the width of the inner or wide portion of the locking formation 68 measured across the tapered sides 70 and 72. The length of the slots 78 is greater than the width of the outer or narrow portion of the locking formation 68. The width of the slots 78 is the same as or slightly greater than the width or thickness of the abutments 54. The slots 78 are located directly behind the respective notches 76.

To assemble the parts of the window unit, the panels 14 and 16 are placed against the spacer flanges 30 and 32 of the frame, inside the retainer flanges 36, 38, 40 and 42 so that the retainer flanges engage the edges of the panels.

The clips are applied by turning them so that the strips 50 extend across the retainer flanges at the top and bottom of the frame, then inserting the narrow portion 56 of abutments 52 into the notches 76, with the wider portions 58 pressing against the outer face of one of the panels 14,16. Then the locking formations 68 are forced inwardly through the slots 78. The clips are sufficiently flexible to permit this. The locking formations at the widest point are wider than the slots 78, requiring substantial pressure to cause the locking formations to pass inwardly completely through the slots. The ends of the slots 78 and the wide portions of the locking formations 68 will yield sufficiently to accomplish this. Once the locking formations 68 have been pressed through the slots, the locking formations are prevented from being retracted because the shoulders 74 engage the side retainer flanges at opposite ends of the slots 78 to provide keepers preventing disassembly.

The horizontal top and bottom edges of the panels are referred to as "side" edges, and the vertical edges of the panels are referred to as "end" edges, but this terminology is arbitrary and is not intended to suggest that the side edges are longer or shorter than the end edges or that such terminology may not be reversed. The same can be said with respect to the sides and ends of the frame, the side and end spacer flanges and side and end retainer flanges.

FIGS. 7 and 8 show a modified clip 19A which differs from the clips 19 previously described in that the abutment or tab 54A does not have an arrow head type locking formation but rather is a rectangular extension of the narrow portion 66 of the clip 19. Thus, the tab 54A has length and thickness dimensions the same as or slightly less than the length and width dimensions of the slots 78. However, to frictionally retain the tabs 54A in the slots, they are bent as shown to provide one or more offset portions 100 and 102 and a slightly curved terminal portion 104. These offset portions are formed by bending the tab about axes parallel to the lengthwise dimension of the slot through which the tab extends. The tab may be flexed inwardly relative to the window unit to enter a slot, and then allowed to return to its natural, free state condition shown in FIG. 8 to frictionally resist removal. The clip can be removed from the slot preferably by pressing inwardly in FIG. 8 on the tab before attempting to withdraw it against the frictional holding action of the offset portions. Except as described, the clip of FIGS. 7 and 8 is like the clips described in FIGS. 1–6.

It will be understood that some or all of the four clips 19 in FIGS. 1–6 may be replaced by clips of the construction shown in FIG. 7 and 8.

What is claimed is:

1. A window unit for an oven door comprising first and second substantially rectangular window panels, each of said panels having an inner face, an outer face, first and second side edges and first and second end edges, an endless, generally rectangular frame for holding said panels in laterally spaced-apart, parallel planes with the inner faces of said panels opposed to one another, the side edges of the first panel respectively parallel and opposed to the side edges of the second panel, and the end edges of the first panel respectively parallel and opposed to the end edges of the second panel, said frame having first and second sides extending along the respective first and second side edges of the panels and first and second ends extending along the respective first and second end edges of the panels, each of said sides and ends of said frame being generally U-shaped in cross-section having laterally spaced radially outwardly extending spacer flanges engaging the inner faces of said panels to hold said panels spaced apart, each of the spacer flanges of the first and second sides of the frame having laterally outwardly extending side retainer flanges extending over the side edges of the panels, each of the spacer flanges of the first and second ends of the frame having laterally outwardly extending end retainer flanges extending over the end edges of the panels, clips for clamping the panels to the frame, said clips each comprising a strip having first and second ends, a first abutment extending in one direction from said first end of said strip substantially perpendicular thereto, a second abutment extending in said one direction from the second end of said strip substantially perpendicular thereto, the strips of at least one of said clips extending across the side retainer flanges at the first side of said frame with the first and second abutments thereof extending over the outer faces of said panels to clamp the panels to the frame, the strips of at least one other of said clips extending across the side retainer flanges at the second side of said frame with the first and second abutments thereof extending over the outer faces of said panels to clamp the panels against the frame, and means for retaining said clips on said frame.

2. A window unit as defined in claim 1, wherein the means for retaining said clips on said frame comprises a locking formation on one of the abutments of each clip, and wherein one of the retainer flanges at each of the first and second sides of the frame has an elongated slot adapted to receive the locking formation.

3. A window unit as defined in claim 2, wherein said locking formation of said one abutment of each of said clips has tapering sides with a maximum width greater than the length of the associated slot but capable of being forced through said slot to be retained therein.

4. A window unit as defined in claim 3, wherein said one abutment of each of said clips has shoulder adjacent said locking formation serving as a keeper to cooperate with said slot in retaining said locking formation in said slot.

5. A window unit as defined in claim 4, wherein the other of said retaining flanges at each of the first and second sides of the frame has a notch to receive the other of the abutments.

6. A window unit as defined in claim 1, wherein one of said abutments of each of said clips comprises a tab, and wherein one of the retainer flanges of each of the first and second sides of the frame has an elongated slot to receive said tab.

7. A window unit as defined in claim 6, wherein the tab of each of said clips is flexible and has a configuration to provide the said means for retaining said clips on said frame.

8. A window unit as defined in claim 6, wherein the tab of each of said clips is flexible and has a cross-section approximating that of said slot, each tab having an offset portion frictionally resisting withdrawal of the tab from the slot and serving as the said means for retaining said clips on said frame.

9. A window unit as defined in claim 8, wherein said offset portion is displaced transversely of the lengthwise dimension of the slot through which said tab extends.

10. A window unit as defined in claim 9, wherein the offset portion is provided by bending the tab about an axis generally parallel to the slot through which it extends.

* * * * *